United States Patent [19]

Schulte

[11] Patent Number: 4,827,758

[45] Date of Patent: May 9, 1989

[54] UPPER TOOL SUPPORT FOR A STAMPING MACHINE OR THE LIKE

[75] Inventor: Karl-Heinz Schulte, Lennestadt, Fed. Rep. of Germany

[73] Assignee: Muhr Und Bender, Attendorn, Fed. Rep. of Germany

[21] Appl. No.: 111,722

[22] Filed: Oct. 22, 1987

[30] Foreign Application Priority Data

Nov. 4, 1986 [DE] Fed. Rep. of Germany ..... 3637486

[51] Int. Cl.[4] ..... B21J 13/00; B21D 37/04

[52] U.S. Cl. ..... 72/446; 72/481

[58] Field of Search ..... 72/441, 442, 444, 446, 72/481, 482

[56] References Cited

FOREIGN PATENT DOCUMENTS 0180146 10/1985 European Pat. Off. .
2940661 4/1981 Fed. Rep. of Germany .

*Primary Examiner*—E. Michael Combs
*Attorney, Agent, or Firm*—Browdy and Neimark

[57] ABSTRACT

An upper tool support (4) for a stamping machine or the like has at least one or several stamping tools (5) adjacently located. Each stamping tool (5) has a punch (7) a punch support (8) and a retaining nut (9) connecting the punch (7), with the punch support (8). The upper tool support (4) is provided with a support body (10), and a receiving plate (11) with a tool guide (12) for each stamping tool (5) extending in the direction of stamping. the upper end of the stamping tool (5) is limited to move in the stamping direction by support flanges (15), being thus guided in the direction of stamping. A receptacle (17) for the upper end of each stamping tool (5) is provided in the support body (10), above the tool guide (12) and below a power transfer area (16). The receptacle (17) is bridged by means of a power transfer rod (18) which is generally movable in a direction perpendicular to the stamping direction. A lifting lever (20) is provided on the support body (10) associated with each stamping tool (5). each lifting lever 20 laterally engages the upper end of the associated stamping tool (5) from below. The upper end of the stamping tool (5) is actively liftable into the receptacle (17) by means of the lifting lever (20) when the power transfer rod (18) is pulled back. In this upper tool support (4), jamming of the stamping tool (5) and the power transfer rod (18) are systematically avoided because the upper end of the stamping tool (5) can be actively lowered out of the receptacle (17) by means of the lifting lever (20) when the power transfer rod is moved forward, namely in the direction toward the receptacle (17). A collision between the upper end of the stamping tool (5) and the power transfer rod (18) is thus made impossible by the forced control.

9 Claims, 5 Drawing Sheets

UPPER TOOL SUPPORT FOR A STAMPING MACHINE OR THE LIKE

BACKGROUND OF THE INVENTION

1. Field of the Invention

The invention relates to an upper tool support for a stamping machine or the like having at least one stamping tool, preferably several stamping tools adjacently located, each stamping tool preferably comprising a punch, a punch support and a retaining nut connecting the punch with the punch support, and having a support body, a receiving plate with a tool guide for each stamping tool extending in the direction of stamping. The upper end of the stamping tool is limited in one direction by support flanges, and is being movably guided in the direction of stamping. A receptacle for the upper end of the stamping tool is provided on the support body above the tool guide and below a power transfer area. The receptacle is bridged by means of a power transfer rod which is generally movable in a direction vertical to the stamping direction. A lifting lever provided on the support body is associated with the stamping tool and laterally engages the upper end of the associated stamping tool from below. The upper end of the stamping tool is actively liftable into the receptacle by means of the lifting lever when the power transfer rod is pulled back.

2. The Prior Art

The following explanations basically relate not only to the upper tool supports of machine tools in the form of stamping machines, but also, for example, to cases where a ratchet-driven tool is disposed in the upper tool support. The teaching of the invention thus is not limited to a stamping machine and stamping tools, but applies to all machine tools in which comparable problems exist. In order to facilitate the understanding of the teaching, the teaching of the invention is described here and below by means of a preferred exemplary embodiment of an upper tool support for a stamping machine.

In a known upper tool support for a stamping machine from out of which the present invention arises (EP-A-No. 0 180 146 or respective prior public use), a quick change of a stamping tool and/or of all stamping tools is possible, but generally has limited space where several stamping tools are located next to each other. This is particularly true where a receiving plate is a part of the support body and where the tool guides are open in the direction towards the front of the support body, in which the upper ends of the stamping tools can be generally pushed into or placed horizontally in the tool guides. A locking cap locks all tool guides together at the open ends. By means of application of the locking cap which is then locked, the open ends of all tool guides in the receiving plate are locked in one step. Thus all stamping tools are secured. For this purpose the individual ends of the stamping tools are provided with hammerhead-like enlargements, and the receiving plate and the locking cap are provided with support flanges corresponding to the hammerhead-like enlargements, so that the stamping tools cannot slip downward out of the tool guides. The locking cap is pivotably fastened on the support body, or on the receiving plate via a pivot axle, and is lockable respectively with the support body or the receiving plate by means of a locking device disposed on the opposite lateral side. The locking device has a locking bolt pivoting in the horizontal plane on the receiving plate and a bolt receptacle provided on the locking cap and open on one side, the locking bolt being pivotable into the bolt receptacle and fixable by means of an adjusting nut for locking. Furthermore, receptacles for the upper ends of the stamping tools are provided in the support body above the tool guides and below a power transfer area, and these receptacles can be bridged by means of power transfer rods generally movable perpendicular to the stamping direction. With each stamping tool is associated a lifting lever, one end of which laterally engages the upper end of the associated stamping tool from below, so that the upper end of the stamping tool can be lifted into the receptacle by means of the lifting lever when the power transfer rod is pulled back. Pneumatic drives or the like, not further described, are provided for this purpose.

In accordance with the state of the art, known from the prior public use, the lifting of the stamping tool into the receptacle at the time the power transfer rod is pulled back is accomplished by forced control of the lifting lever. For this purpose the lifting lever is in the shape of a two-armed lever which is pivotably fixed on the support body below the power transfer rod by means of a pivot axle. The arm of the lifting lever pointing away from the receptacle is provided with a lift control surface which alternately acts with the side of the power transfer rod oriented away from the receptacle. If the power transfer rod is pulled out of the receptacle, the side of the power transfer rod oriented away from the receptacle glides onto the lift control surface of the lifting lever and thereby pushes this arm of the lifting lever downwards. The other, opposite arm of the lifting lever is correspondingly raised and the upper end of the stamping tool and thus the entire stamping tool is raised with it. When the side of the power transfer rod oriented away from the receptacle crosses the arm of the lifting lever, the end position of the punch in the receptacle is thus defined by the underside of the power transfer rod.

If the power transfer rod is then pushed forward again in the direction of the receptacle, the rear arm of the lifting lever is freed again. The stamping tool sinks downward out of the receptacle by its own weight and carries along with its upper end the arm of the lifting lever which is located there.

In practical use it has been shown that the lowering of the stamping tool by its own weight is not sufficiently dependable. It can sometimes happen that the stamping tool gets hung up in the tool guide so high that the upper end remains in the receptacle. The power transfer rod which is being pushed forward by the control drive meets the side of the upper end of the stamping tool and completely jams it.

SUMMARY OF THE INVENTION

It is an object of the invention to design and improve the known upper tool support in such a way that jamming between the stamping tool and the power transfer rod is systematically avoided.

The upper tool support according to the invention in which the above mentioned object is attained is characterized in that by means of the lifting lever, the upper end of the stamping tool can be actively lowered out of the receptacle when the power transfer rod is pushed forward, so that a collision of the upper end of the stamping tool with the power transfer rod is positively prevented by forced control. In accordance with the invention the stamping tool can be lowered, when the power transfer rod is pushed forward, not only passively under the influence of its own weight, but actively by means of the lifting lever in the sense of a forced control. The basic principle of forced control for the lifting of the stamping tool by means of the lifting lever can also be used for the lowering of the stamping tool. Furthermore, there naturally are different possibilities for the embodiment of such forced control.

In accordance with the invention there are a number of possibilities for designing and improving the upper tool support for a stamping machine or the like. There follows a description of a preferred exemplary embodiment in reference to the drawings.

DESCRIPTION OF PREFERRED EMBODIMENT

Figure 1:
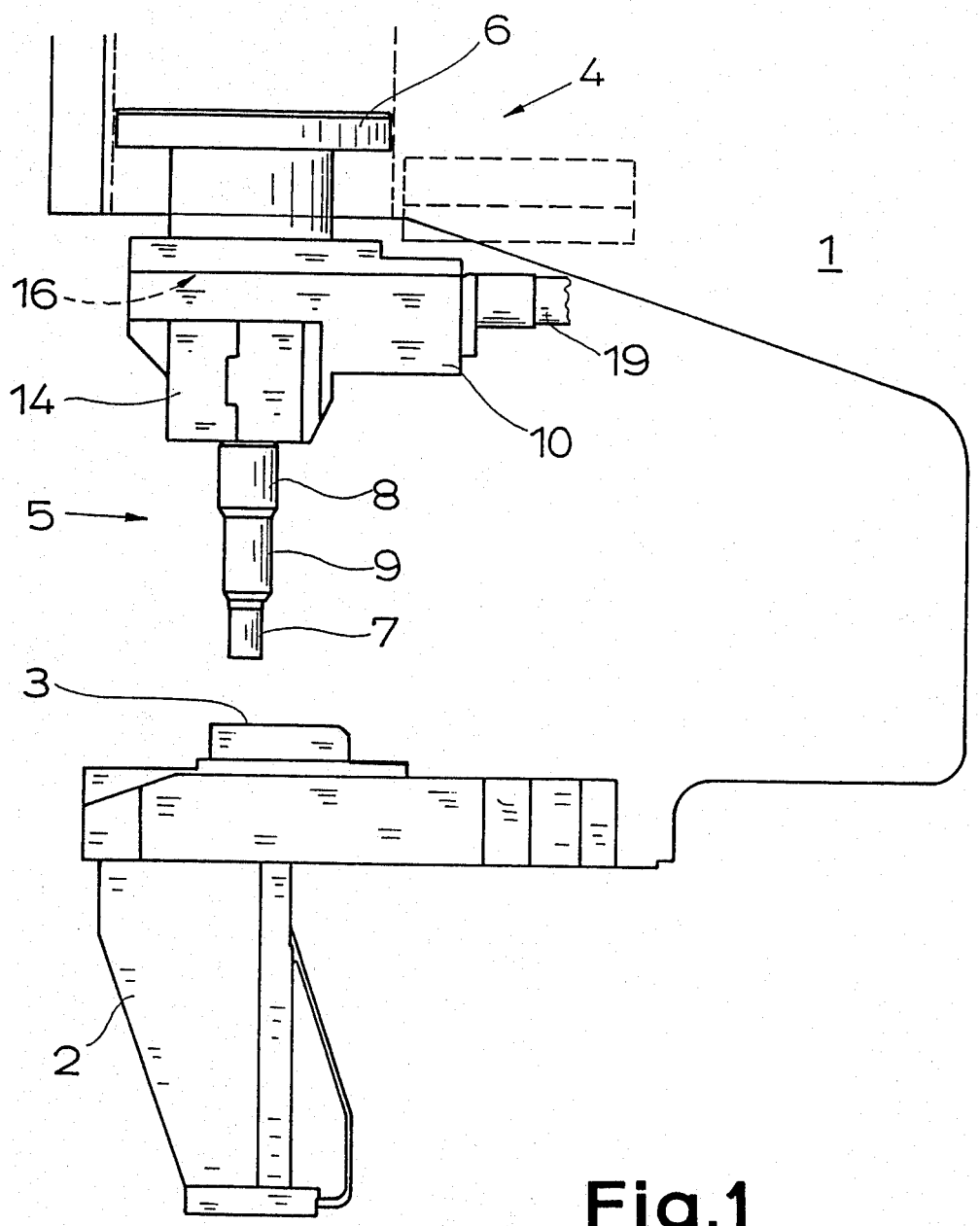
FIG. 1 is a schematic side view of a machine tool, in the present case a punching press.

FIG. 1 indicates a preferred exemplary embodiment of the invention, namely a machine tool such as a punching press having a machine body 1 generally in the form of the letter C, a lower tool support 2 provided or fixed on the machine body 1 with a lower tool 3, and an upper tool support 4 with an upper tool, in this case a stamping tool 5. The stamping tool 5 is provided or fixed on the upper part of the machine body 1. As indicated, a drive head 6, for example in the form of a hydraulic cylinder-piston device, is located on the upper tool support 4, or on the machine body 1 above the upper tool support 4, by means of which the stamping tool 5 can be lowered for operation in the direction of the lower tool 3.

Figure 2:
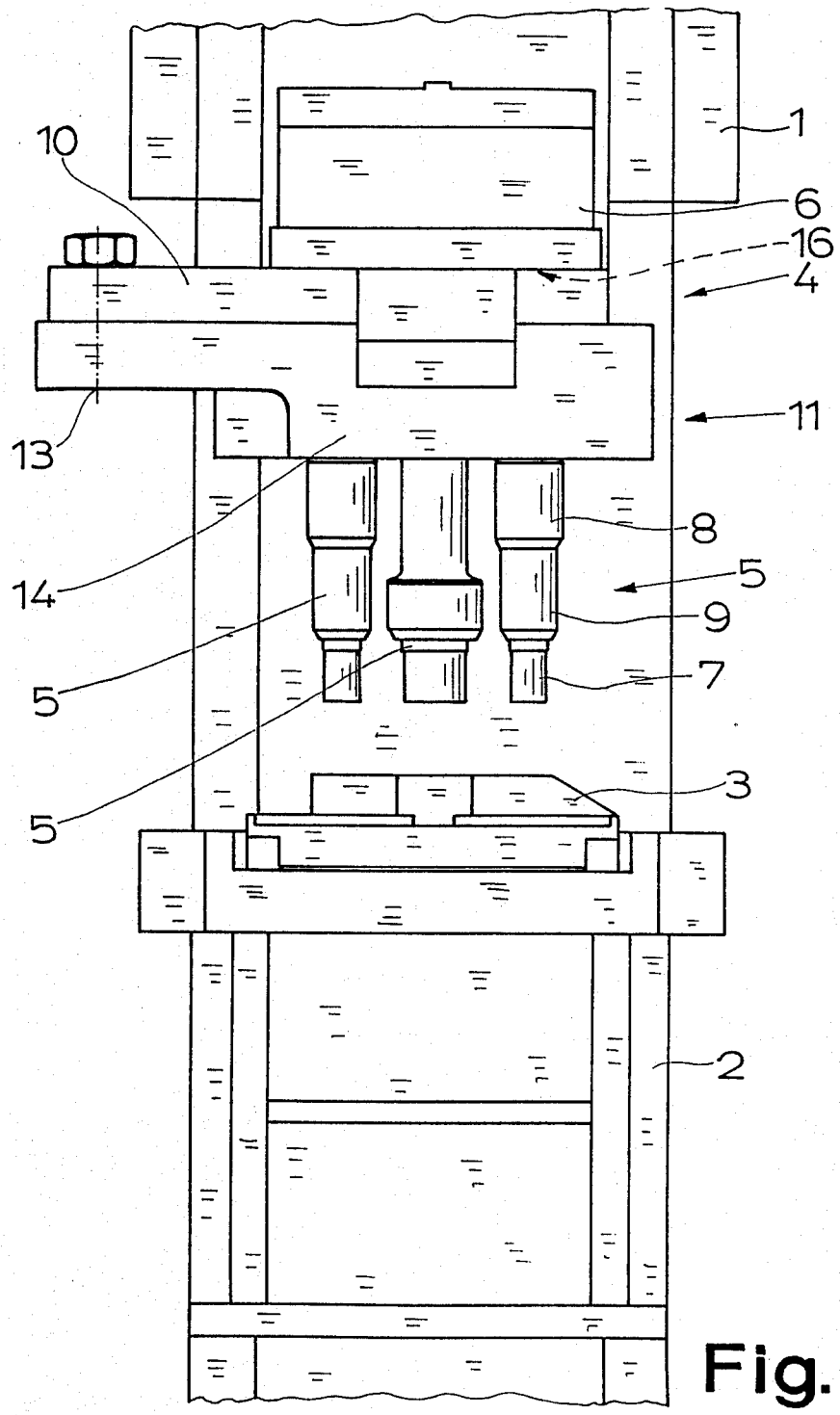
FIG. 2 is a front view of the punching press.

As FIGS. 1 and 2 show in combination, the upper tool support 4 shown here is characterized in that a plurality or stamping tools 5, in these illustrated case three stamping tools 5 located next to each other are provided. In the exemplary embodiment, each stamping tool 5 includes a punch 7, a punch support 8 and a retaining nut 9 connecting the punch 7 with the punch support 8. As shown in FIG. 2, the three stamping tools 5 are placed as closely next to each other.

Figure 3:
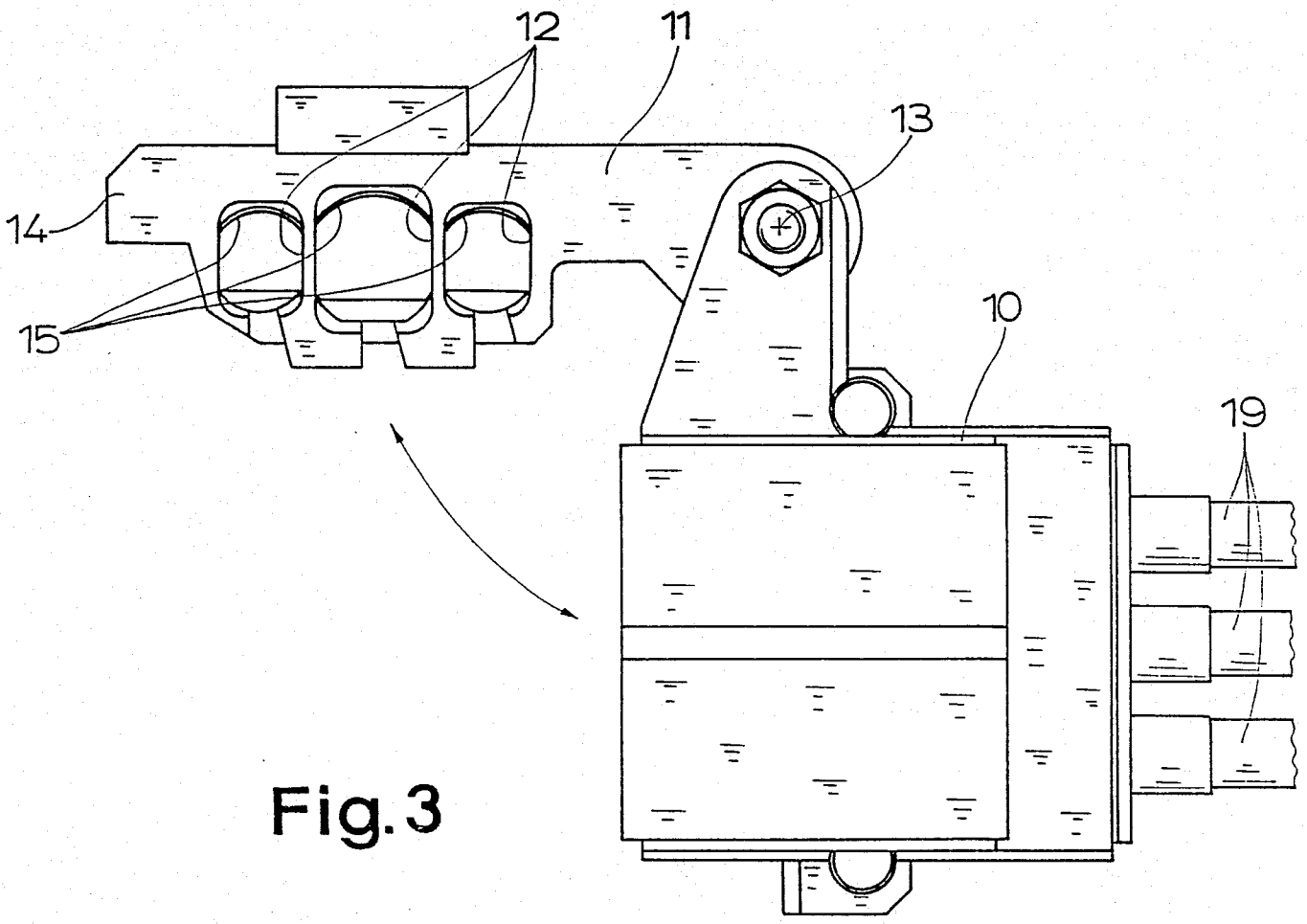
FIG. 3 is a top view of the punching press.

FIGS. 1 and 2 show that the upper tool support 4 in the exemplary embodiment shown here has a support body 10 as well as a receiving plate 11 supported from the support body 10. FIG. 3 illustrates that tool guides 12 have been provided for each stamping tool 5 and are placed next to each other extending in the direction of stamping. FIGS. 1, 2 and 3 taken together further illustrate that the upper tool support 4 has a locking cap 14 fastened on the support body 10 which, according to the exemplary embodiment, is pivotable around a pivot axle 13 on the support body 10. FIGS. 1 and 2 together show also that the upper ends of the stamping tools 5 are guided movably in the direction of stamping, in this case vertically, in the tool guides 12. Support flanges 15 are shown in FIGS. 3, for preventing the stamping tools 5 from falling downward out of the tool guides 12.

Although not shown in the drawings, the upper ends of the stamping tools 5 are typically provided with hammerhead-like enlargements which bear against the support flanges 15 provided in the tool guides 12, so that the downward slipping-through of the stamping tools 5 is prevented. This can be found in the state of the art which is the basis of the invention. Also, further details of the upper tool support 4 can be seen from the prior art publication of EP-A-No. 0 180 146.

Figure 4:
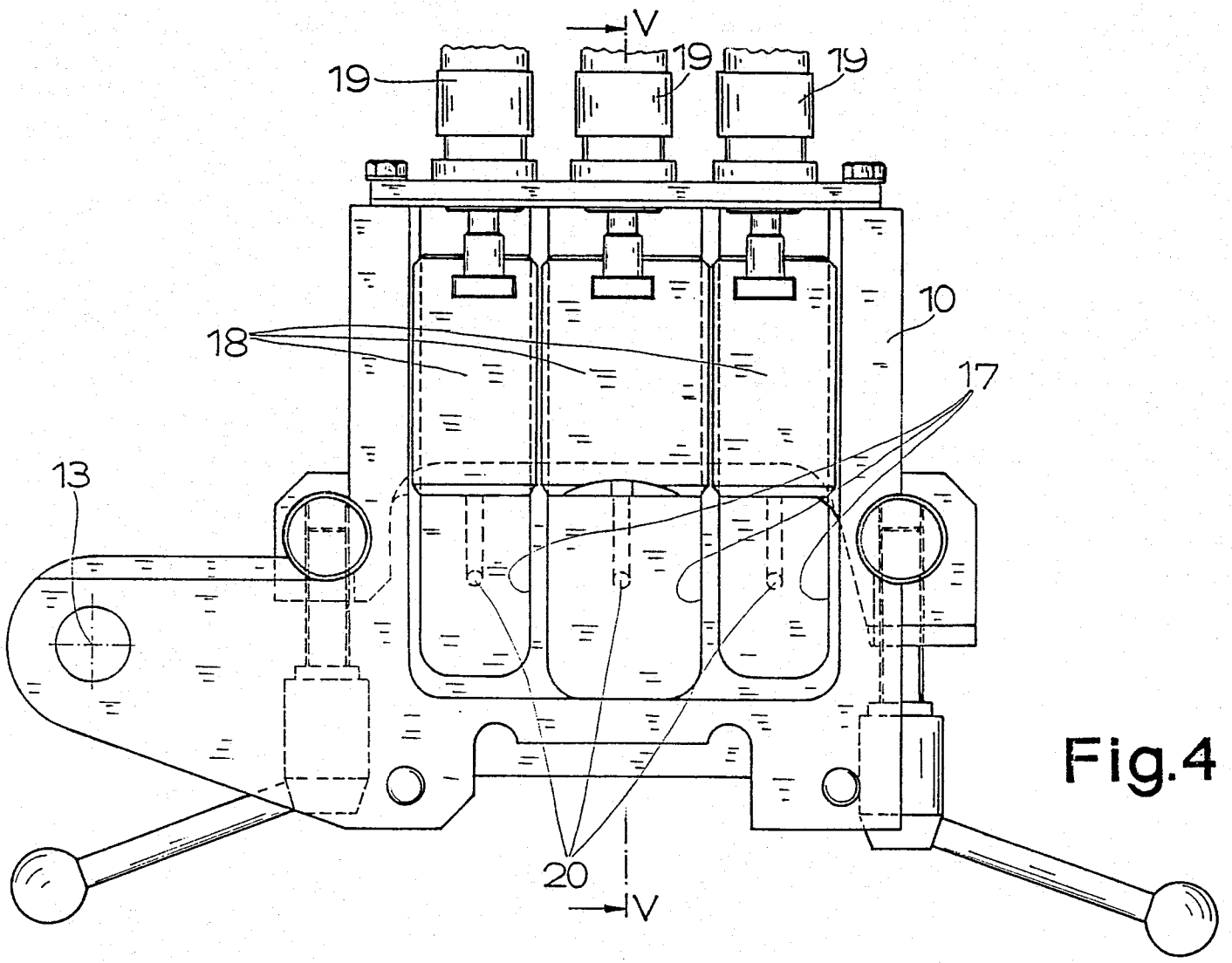
FIG. 4 is a top view of the punching press with the drive head removed.

As shown in FIG. 4 of the drawings, receptacles 17 for the upper ends of the stamping tools 5 are also provided in the upper tool support 4, as described here in the support body 10 above the tool guides 12 and below a power transfer area 16. Bridging of the force from the power transfer area 16 to the receptacles 17 can be provided by means of power transfer rods 18 or the like, generally movable perpendicularly to the stamping direction, with the aid of actuating drives 19 as illustrated here in the form of pneumatic cylinder-piston units. The power transfer area 16 is disposed on the underside of the drive head 6. This arrangement makes it possible that during the downstroke of the power transfer area 16 only one stamping tool 5 that is desired to be actively moved downward can be selected, namely the stamping tool 5 for which the power transfer rod 18 bridges the associated receptacle 17, while the other two stamping tools 5 can move back into their respective associated receptacles 17. In order to prevent the situation of the non-activated stamping tools 5 being moved back up by contact of the stamping tools 5 with the upper side of a work piece, and into the receptacles 17 to instead return them actively by other means into the receptacles 17, it is also known to associate with each stamping tool 5 a lifting lever 20 disposed on the support body 10. FIG. 4 indicates the lifting lever 20 for each receptacle 17. The lifting lever 20 can laterally engage the upper end of the associated stamping tool 5 from below, so that the upper end of the stamping tool 5 can be lifted into the receptacle 17 by means of the lifting lever 20 when the power transfer rod 18 is pulled back.

Figure 5:
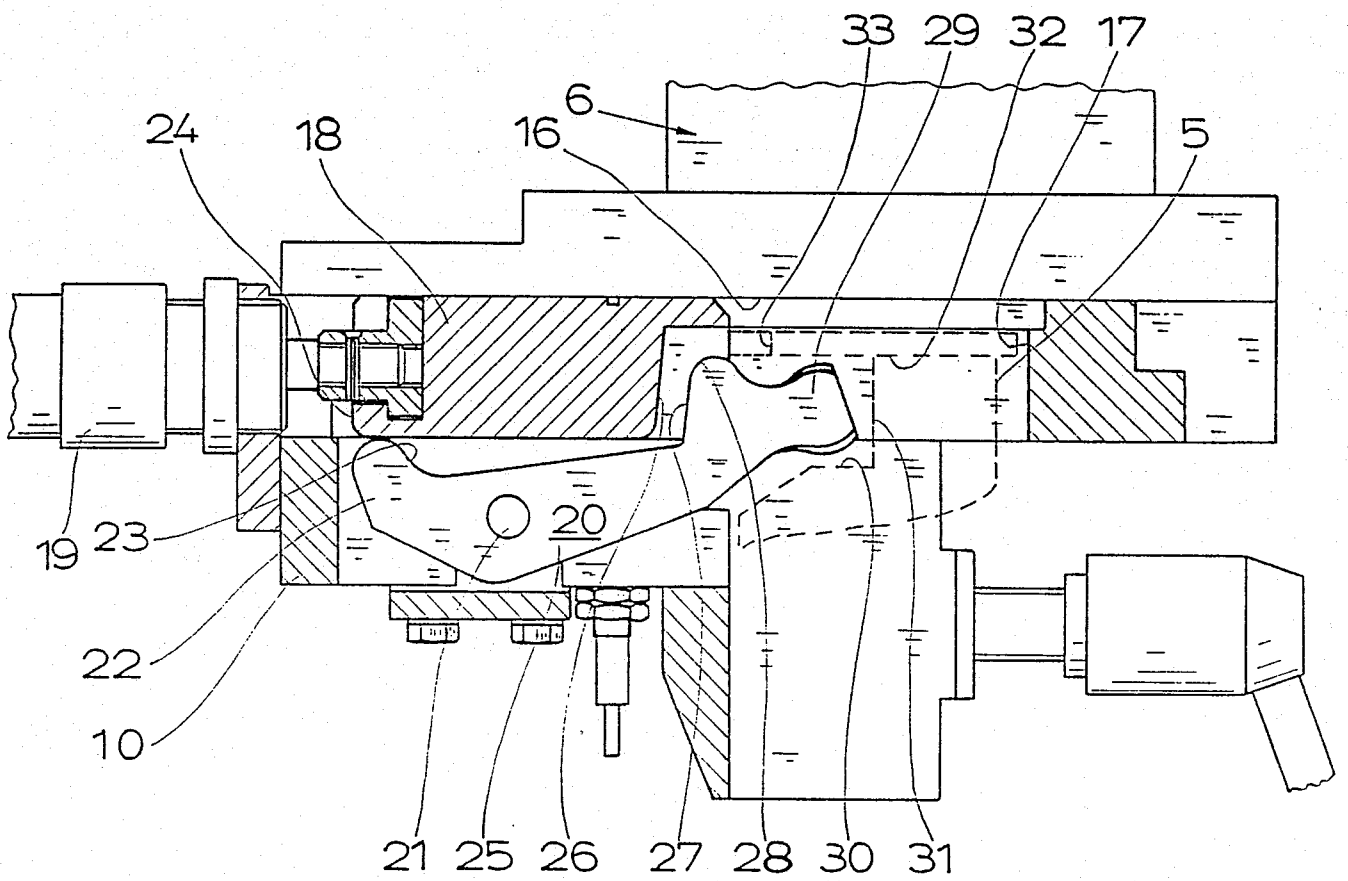
FIG. 5 is a section through the punching press along the line V—V in FIG. 4.

Because of the sectional view chosen, FIG. 5 shows a lifting lever 20 for a stamping tool 5 in more detail. In the first place it can be clearly seen that in the preferred exemplary embodiment shown here, as well as in the state of the art which has become known by prior public use, the lifting lever 20 is embodied as a two-armed lever which is pivotable around a pivot axle 21 in the support body 10, in a vertical plane which includes the direction of stamping. One arm 22 has a lift control surface 23 which alternately coacts with the side 24 of the power transfer lever 18 oriented away from the receptacle 17, as is known from the state of the art. When the power transfer rod 18 is pulled out of the receptacle 17, the side 24 oriented away from it pushes the arm 22 downwards via the lift control surface 23 and finally overruns the arm 22 (FIG. 5). By means of this the second arm 25 of the lifting lever 20 is pulled up and thereby actively lifts the upper end of the stamping tool 5 into the receptacle 5. The stamping tool 5 is indicated in dashed lines in FIG. 5.

According to the present invention, in addition to the forced control for lifting the stamping tool 5 known from the state of the art because of known prior public use, a forced control for the lowering of the stamping tool 5 is provided, in that the upper end of the stamping tool 5 can be actively lowered by means of the lifting lever 20 when the power transfer rod 18 is pushed into the receptacle 17. Thus any collision of the stamping tool 5 with the power transfer rod 17 is systematically avoided.

The result described above is practically achieved in the preferred embodiment shown in that the lifting lever 20 has a descent control surface 27 which alternately coacts with the side 26 of the power transfer rod 18 oriented towards the receptacle 17, and in that the side 26 of the power transfer rod 18 oriented towards the receptacle 17 descendingly comes to rest on the descent control surface 27 of the lifting lever 20 before the side 26 comes into contact with the upper end of the stamping tool 5. In the preferred embodiment shown here, the structural design, particularly the inclination of the side 26 and of the descent control surface 27, is selected such that the descent control surface 27 is overrun by the side 26 of the power transfer rod 18 oriented towards the receptacle 17. The underside of the power transfer rod 18 therefore also defines in this way the lowered position of the stamping tool 7.

As seen from the above description, the descent control surface 27 requires a defined relative position in respect to the side 26 of the power transfer rod 18. For this purpose it is structurally advantageous to provide, on the lifting lever 20, on the the end which engages the upper end of the stamping tool 5 from below and in a position towards the side 26 of the power transfer rod 18, a control lug 28 which supports the descent control surface 27 and protrudes into the forward path of the power transfer rod 18.

It is further recommended, as shown in FIG. 5, that the lifting lever 20 have a control head 29 which engages the upper end of the stamping tool 5 from below and a pressure control surface 30 below the upper end of the stamping tool 5 and that the control head 29 come to a position of rest in a power transferring manner on the pressure control surface 30.

In the preferred embodiment of the invention shown in FIG. 5, the stamping tool 5 has a recess 31 open on the side below the upper end. A lifting control surface 32 is embodied on the top side of the recess 31 and a pressure control surface 30 for the control head 29 on the bottom side. Furthermore, as can be seen here, the control head 29 is rounded for reducing wear. Finally it can be clearly seen that the recess 31 has an engagement channel 33 for the control lug 28 on the lifting lever 20. This is necessary in the exemplary embodiment shown here because the plate forming the upper end of the stamping tool 5 is relatively thick and therefore the control lug 28 cannot move into the recess 31 underneath this plate.

Altogether, a forced control of the upward as well downward movement of the stamping tool 5 is assured in FIG. 5 by the teaching of the invention which makes it impossible that the stamping tool 5 can collide with and jam with its upper end the power transfer rod 18.

What is claimed is:

1. An upper tool support for a stamping machine or the like having at least one stamping tool displaceable in its longitudinal direction for stamping, comprising:

a support body having a power transfer area;

a receiving plate with a tool guide for said stamping tool extending in said stamping direction, said stamping tool being movably guided in said stamping direction by said tool guide;

support flanges provided as part of said tool guide in said receiving plate, for limiting the movement of an upper end of said stamping tool in a direction away from said power transfer area, i.e. downwardly, a receptacle for said upper end of said stamping tool being provided in said support body above said tool guide and below said power transfer area, a power transfer rod bridging said receptacle and being movable in a direction generally perpendicular to said stamping direction into or out of said receptacle, and a lifting lever mounted on said support body next to said stamping tool, said lifting lever laterally engaging said upper end of said stamping tool from below, wherein by means of said lifting lever said upper end of said stamping tool is actively lowered out of said receptacle when said power transfer rod is moved into said receptacle, so that a collision of said upper end or said stamping tool with said power transfer rod is positively prevented, and actively lifted into said receptacle when said power transfer rod is moved out of said receptacle, wherein for said active lowering of said stamping tool said lifting lever has a descent control surface coacting with a descent side of said power transfer rod oriented towards said receptacle, and said descent side of said power transfer rod descendingly rests on said descent control surface of said lifting lever before said descent side can come into contact with said upper end of said stamping tool, and wherein for said active lifting of said stamping tool said lifting lever has a lift control surface coacting with a lifting side of said power transfer rod oriented away from said receptacle.

2. The tool support of claim 1, wherein said descent control surface of said lifting lever is overrun by said descent side of said power transfer rod when said power transfer rod is moved into said receptacle.

3. The tool support of claim 1, comprising a control lug on said lifting lever oriented towards said power transfer rod and protruding into the path of said power transfer rod, said descent control surface being formed on said control lug.

4. The tool support of claim 1, wherein said stamping tool has a power transmitting surface below said upper end, said lifting lever has a control head positioned below said upper end of said stamping tool but above said power transmitting surface, and said control head comes into contact with said power transmitting surface when said power transfer rod is moved into said receptacle, thus lowering said upper end of said stamping tool out of said receptacle.

5. The tool support of claim 4, wherein said stamping tool has a laterally open recess below said upper end, said control head extending into said recess laterally.

6. The tool support of claim 4, wherein said control head is rounded to decrease wear.

7. The tool support of claim 3, wherein said stamping tool has a power transmitting surface below said upper end, said lifting lever has a control head positioned below said upper end of said stamping tool but above said power transmitting surface, and said control head comes into contact with said power transmitting surface when said power transfer rod is moved into said receptacle, thus lowering said upper end of said stamping tool out of said receptacle.

8. The tool support of claim 7, wherein said recess has a specific engagement channel for said control lug.

9. The tool support of claim 1, comprising a plurality of stamping tools and the respective components associated therewith.

* * * * *